US010127892B2

(12) United States Patent
Abileah et al.

(10) Patent No.: US 10,127,892 B2
(45) Date of Patent: Nov. 13, 2018

(54) DISPLAY DEVICE USING OVERLAPPED DATA LINES NEAR CENTER TO DIM MURA DEFECT

(71) Applicant: a.u. Vista, Inc., Milpitas, CA (US)

(72) Inventors: Adiel Abileah, Milpitas, CA (US); Seok-Lyul Lee, Hsin-chu (TW)

(73) Assignee: a.u. Vista, Inc., Milpitas, CA (US)

( * ) Notice: Subject to any disclaimer, the term of this patent is extended or adjusted under 35 U.S.C. 154(b) by 74 days.

(21) Appl. No.: 15/349,436

(22) Filed: Nov. 11, 2016

(65) Prior Publication Data

US 2018/0137836 A1 May 17, 2018

(51) Int. Cl.
*G09G 5/10* (2006.01)
*G09G 5/00* (2006.01)

(52) U.S. Cl.
CPC ..... *G09G 5/10* (2013.01); *G09G 5/003* (2013.01); *G09G 2310/0251* (2013.01); *G09G 2310/0275* (2013.01); *G09G 2320/0233* (2013.01); *G09G 2320/0626* (2013.01)

(58) Field of Classification Search
None
See application file for complete search history.

(56) References Cited

U.S. PATENT DOCUMENTS

2005/0151830 A1 7/2005 Yamazaki
2006/0055645 A1 3/2006 Kim
2013/0135845 A1* 5/2013 Matsui ..... G09F 13/04 362/97.1
2014/0055503 A1* 2/2014 Jung ..... G09G 5/10 345/690

* cited by examiner

*Primary Examiner* — Ifedayo B Iluyomade
(74) *Attorney, Agent, or Firm* — Locke Lord LLP; Tim Tingkang Xia, Esq.

(57) ABSTRACT

A display device using overlapped data lines to dim the Mura defect. The display device includes multiple pairs of data lines, and each pair of data lines includes a top data line and a bottom data line. The top data line and the bottom data line overlap in a center area, and each of the pixels in the center area includes two subpixels respectively connected to the corresponding top and bottom data lines. For each pixels in the center area, each of the two subpixels has a corresponding weighting factor. From top to bottom of the center area, the weighting factors of the top subpixels gradually decrease, and the weighting factors of the bottom subpixels gradually increase.

20 Claims, 10 Drawing Sheets

DISPLAY DEVICE USING OVERLAPPED DATA LINES NEAR CENTER TO DIM MURA DEFECT

FIELD

The disclosure relates generally to display technology, and more particularly to a display device using overlapped data lines to dim the brightness non-uniformity (Mura) defect.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In a high resolution display device, the dwelling time per addressed line (and pixels) is very limited. In some case, the display device may use addressing from both top and bottom column drivers at the same time. However, the center area of the display device may show a dividing line separating the top and bottom halves of the display device. The dividing line problem, generally referred to as the "Mura" defect, is caused by discontinuity or mismatch of the top and the bottom drivers, and slight variation in speed of charging the pixels.

Therefore, a heretofore unaddressed need exists in the art to address the aforementioned deficiencies and inadequacies.

SUMMARY

One aspect of the disclosure relates to a display device, which includes: a plurality of pixels arranged in a pixel matrix having a plurality of rows and a plurality of columns; a top data driver and a bottom data driver respectively disposed at opposite two sides of the display device; and a plurality of pairs of data lines extending along a vertical direction, each pair of data lines comprising a top data line electrically connected to the top data driver and a bottom data line electrically connected to the bottom data driver, wherein each of the pixels in each column of the pixel matrix is connected to a corresponding pair of data lines. In certain embodiments, the pixel matrix is divided into a top area, a center area and a bottom area, and for each pair of data lines, the top data line and the bottom data line overlap in the center area. For each column of the pixel matrix, each of the pixels in the top area is electrically connected to the top data line of the corresponding pair of data lines; each of the pixels in the bottom area is electrically connected to the bottom data line of the corresponding pair of data lines; each of the pixels in the center area comprises a top subpixel electrically connected to the top data line of the corresponding pair of data lines and having a first weighting factor, and a bottom subpixel electrically connected to the bottom data line of the corresponding pair of data lines and having a second weighting factor, wherein a sum of the first weighting factor of the top subpixel and the second weighting factor of the bottom subpixel is 100%; and from top to bottom of the center area, the first weighting factors of the top subpixels gradually decrease, and the second weighting factors of the bottom subpixels gradually increase. In certain embodiments, the center area comprises, from top to bottom of the center area: a first row of pixels, each having a first top subpixel and a first bottom subpixel; a second row of pixels, each having a second top subpixel and a second bottom subpixel; a third row of pixels, each having a third top subpixel and a third bottom subpixel; and a fourth row of pixels, each having a fourth top subpixel and a fourth bottom subpixel.

In certain embodiments, for each of the pixels in the first row, the first weighting factor of the first top subpixel is 80%, and the second weighting factor of the first bottom subpixel is 20%; for each of the pixels in the second row, the first weighting factor of the second top subpixel is 60%, and the second weighting factor of the second bottom subpixel is 40%; for each of the pixels in the third row, the first weighting factor of the third top subpixel is 40%, and the second weighting factor of the third bottom subpixel is 60%; and for each of the pixels in the fourth row, the first weighting factor of the fourth top subpixel is 20%, and the second weighting factor of the fourth bottom subpixel is 80%.

A further aspect of the disclosure relates to a display device, which includes: a plurality of pixels arranged in a pixel matrix having a plurality of rows and a plurality of columns; a top data driver and a bottom data driver respectively disposed at opposite two sides of the display device; and a plurality of pairs of data lines extending along a vertical direction, each pair of data lines comprising a top data line electrically connected to the top data driver and a bottom data line electrically connected to the bottom data driver, wherein each of the pixels in each column of the pixel matrix is connected to a corresponding pair of data lines. The pixel matrix is divided into a top area, a center area and a bottom area, and for each pair of data lines, the top data line and the bottom data line overlap in the center area. The center area includes a plurality of rows of the pixels. For each column of the pixel matrix, each of the pixels in the center area comprises a top subpixel electrically connected to the top data line of the corresponding pair of data lines and having a first weighting factor, and a bottom subpixel electrically connected to the bottom data line of the corresponding pair of data lines and having a second weighting factor; and from top to bottom of the center area, the first weighting factors of the top subpixels gradually decrease, and the second weighting factors of the bottom subpixels gradually increase.

In certain embodiments, for each column of the pixel matrix, each of the pixels in the top area is electrically connected to the top data line of the corresponding pair of data lines; and each of the pixels in the bottom area is electrically connected to the bottom data line of the corresponding pair of data lines.

In certain embodiments, for each of the pixels in the center area, a sum of the first weighting factor of the top subpixel and the second weighting factor of the bottom subpixel is 100%.

In certain embodiments, the gradual decreasing of the first weighting factors of the top subpixels and the gradual increasing of the second weighting factors of the bottom subpixels from top to bottom are linear.

In certain embodiments, for the pixels in each row of the center area, the first weighting factors of the top subpixels are identical, and the second weighting factors of the bottom subpixels are identical.

In certain embodiments, for the pixels in each row of the center area, at least two of the top subpixels have different first weighting factors.

In certain embodiments, the center area comprises, from top to bottom of the center area: a first row of pixels, each having a first top subpixel and a first bottom subpixel; a second row of pixels, each having a second top subpixel and a second bottom subpixel; a third row of pixels, each having a third top subpixel and a third bottom subpixel; and a fourth row of pixels, each having a fourth top subpixel and a fourth bottom subpixel.

In certain embodiments, for each of the pixels in the first row, the first weighting factor of the first top subpixel is 80%, and the second weighting factor of the first bottom subpixel is 20%; for each of the pixels in the second row, the first weighting factor of the second top subpixel is 60%, and the second weighting factor of the second bottom subpixel is 40%; for each of the pixels in the third row, the first weighting factor of the third top subpixel is 40%, and the second weighting factor of the third bottom subpixel is 60%; and for each of the pixels in the fourth row, the first weighting factor of the fourth top subpixel is 20%, and the second weighting factor of the fourth bottom subpixel is 80%.

In certain embodiments, for each of the pixels in the center area, the top subpixel has a relative size of the pixel proportional to the first weighting factor, and the bottom subpixel has a relative size of the pixel proportional to the second weighting factor.

In certain embodiments, for each of the pixels in the center area, a top data voltage received by the top subpixel is proportional to the first weighting factor, and a bottom data voltage received by the bottom subpixel is proportional to the second weighting factor.

In certain embodiments, the display device further includes: a computation module configured to, for each of the pixels in the center area: calculate the top data voltage and the bottom data voltage according to the first and second weighting factors; control the top data driver to provide the top data voltage to the top subpixel; and control the bottom data driver to provide the bottom data voltage to the bottom subpixel.

In certain embodiments, the display device further includes: a plurality of scan lines extending along a direction perpendicular to the pairs of data lines, each of the scan lines corresponding to one of the rows of pixels. For each of the pixels in the center area, the top subpixel comprises a top transistor having a gate, a source and a drain, and the bottom subpixel comprises a bottom transistor having a gate, a source and a drain, wherein the source of the top transistor is electrically connected to the top data line of the corresponding pair of data lines, the source of the bottom transistor is electrically connected to the bottom data line of the corresponding pair of data lines, and the gate of the top transistor and the gate of the bottom transistor are respectively electrically connected to the corresponding scan line.

In certain embodiments, each of the pixels in the center area further comprises: at least one top resistor connected to the top subpixel, configured to split a voltage provided by the top data driver to the source of the top transistor, such that the top data voltage received by the top subpixel is the voltage provided by the top data driver multiplying the first weighting factor; and at least one bottom resistor connected to the bottom subpixel, configured to split a voltage provided by the bottom data driver to the source of the bottom transistor, such that the bottom data voltage received by the bottom subpixel is the voltage provided by the bottom data driver multiplying the second weighting factor.

In certain embodiments, each of the pixels in the center area further comprises: a plurality of top capacitors electrically connected to the drain of the top transistor, comprising a top storage capacitor $C_{STt}$; and a plurality of bottom capacitors electrically connected to the drain of the bottom transistor, comprising a bottom storage capacitor $C_{STb}$; wherein capacitances of the top storage capacitor $C_{STt}$ and the bottom storage capacitor $C_{STb}$ are respectively configured such that the top data voltage received by the top subpixel is proportional to the first weighting factor, and the bottom data voltage received by the bottom subpixel is proportional to the second weighting factor.

In a further aspect of the disclosure, a pixel driving method may be applied to the display device as described above, by providing a top data voltage to the top subpixel proportional to the first weighting factor, and providing a bottom data voltage to the bottom subpixel proportional to the second weighting factor for each of the pixels in the center area.

In a further aspect of the disclosure, a display device is provided. The display device comprises a plurality of pixels arranged in a pixel matrix having a plurality of rows and a plurality of columns; a top data driver and a bottom data driver respectively disposed at opposite two sides of the display device, and a plurality of pairs of data lines extending along a vertical direction, each pair of data lines comprising a top data line electrically connected to the top data driver and a bottom data line electrically connected to the bottom data driver, wherein each of the plurality of pixels in each of the plurality of columns of the pixel matrix is connected to a corresponding pair of data lines. The pixel matrix is divided into a top area, a center area and a bottom area, and for each pair of data lines, the top data line and the bottom data line overlap in the center area. The center area comprises a plurality of rows of the pixels. For each column of the pixel matrix, each of the plurality of pixels in the center area comprises a top subpixel electrically connected to the top data line of the corresponding pair of data lines and having a first relative size of the pixel, and a bottom subpixel electrically connected to the bottom data line of the corresponding pair of data lines and having a second relative size of the pixel. From top to bottom of each row of the center area, the first relative sizes of the pixel gradually decrease, and the second relative size of the pixel gradually increase.

In a further aspect of the disclosure, a display device is provided. The display device comprises a plurality of pixels arranged in a pixel matrix having a plurality of rows and a plurality of columns; a top data driver and a bottom data driver respectively disposed at opposite two sides of the display device, and a plurality of pairs of data lines extending along a vertical direction, each pair of data lines comprising a top data line electrically connected to the top data driver and a bottom data line electrically connected to the bottom data driver, wherein each of the plurality of pixels in each of the plurality of columns of the pixel matrix is connected to a corresponding pair of data lines. The pixel matrix is divided into a top area, a center area and a bottom area, and for each pair of data lines, the top data line and the bottom data line overlap in the center area. The center area comprises a plurality of rows of the pixels. For each column of the pixel matrix, each of the plurality of pixels in the center area comprises a top subpixel electrically connected to the top data line of the corresponding pair of data lines and having a first storage capacitor electrically connected to a drain of a first transistor, and a bottom subpixel electrically connected to the bottom data line of the corresponding pair of data lines and having a second storage capacitor electrically connected to a drain of a second transistor. From top to bottom of each row of the center area, a capacity of each of the first storage capacitors gradually decreases, and a capacity of each of the second storage capacitors gradually increase.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION OF THE DISCLOSURE

Figure 1:
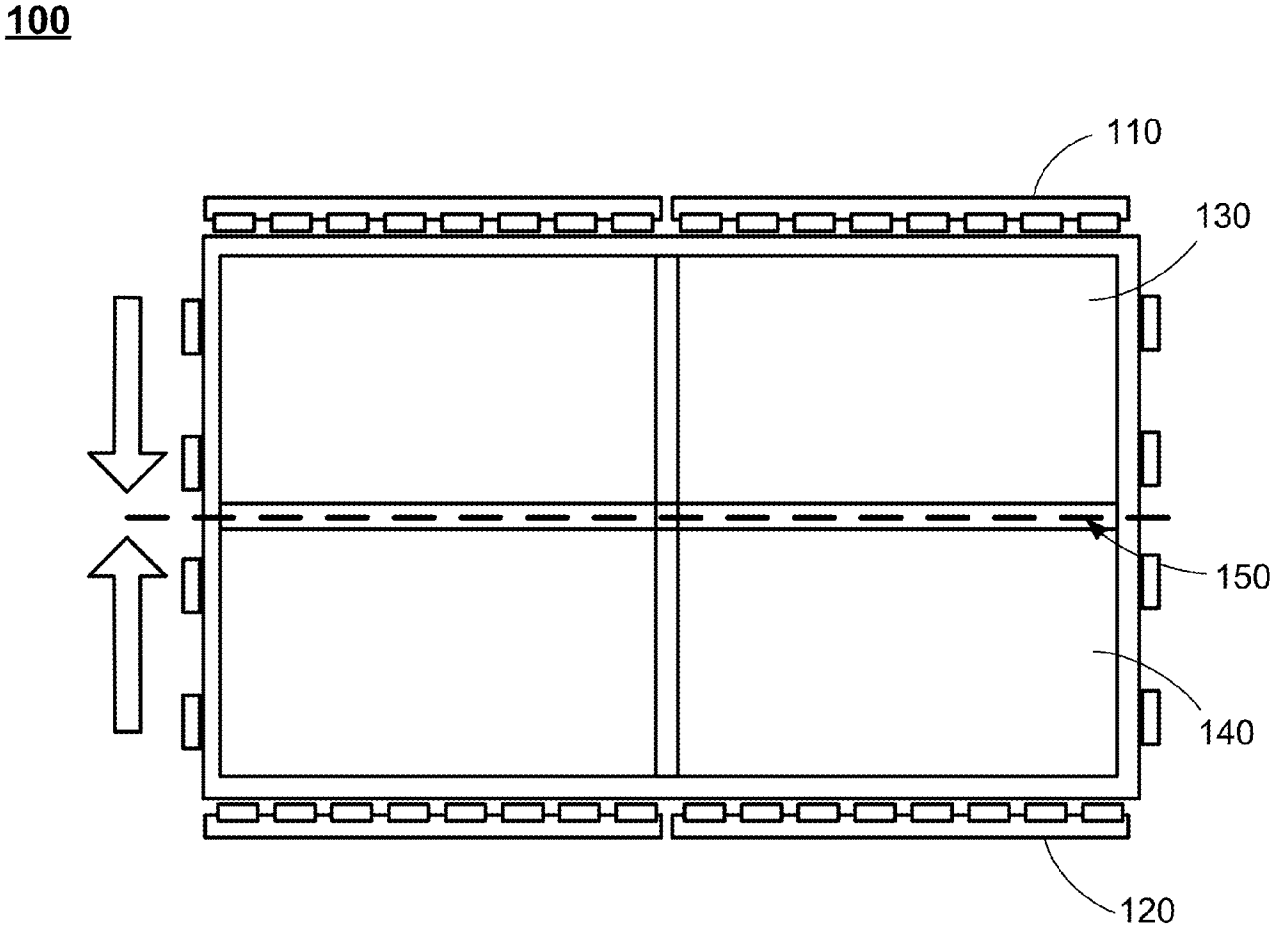
FIG. 1 schematically shows a display device having the Mura defect according to certain embodiments of the present disclosure.

The present disclosure will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the disclosure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top", and "left" and "right", may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper", depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the term "module" may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The description will be made as to the embodiments of the present disclosure in conjunction with the accompanying drawings. In accordance with the purposes of this disclosure, as embodied and broadly described herein, this disclosure, in certain aspects, relates to a display device using overlapped data lines to dim the brightness non-uniformity (Mura) defect.

As disclosed above, with the limited dwelling time of the high resolution display device, the display device may use driving configuration from multiple data drivers (also referred to as the source drivers), one on the top and the other on the bottom, to drive the pixels at the same time. However, the Mura defect may occur at the center area of the display device, showing a dividing line separating the top and bottom halves of the display device. FIG. 1 schematically shows a display device having the Mura defect according to certain embodiments of the present disclosure. As shown in FIG. 1, the display device 100 may have multiple data drivers 110 and 120 at the top and bottom of the display device 100, driving the pixels on the top half area 130 and the bottom half area 140 respectively. Specifically, as shown in the arrows on the left of FIG. 1, the top data drivers 110 drive the pixels on the top half area 130 from top to bottom, and the bottom data drivers 120 drive the pixels on the bottom half area 140 from bottom to top. However, due to the Mura defect, a visible dividing line 150, shown as the dotted line in FIG. 1 between the areas 130 and 140, may appear on the display device 100 to separate the two areas 130 and 140 of the display device 100. In mid-gray levels and moderate luminance, the eye of human beings is sensitive to as low as 3% luminance variations. This makes the visible Mura defect (i.e., the brightness non-uniformity) very prominent. Thus, there is a need for a mechanism to blur the dividing line in order to reduce the Mura defect.

In order to solve the Mura defect, one aspect of the present disclosure relates to a display device, which includes: a plurality of pixels arranged in a pixel matrix having a plurality of rows and a plurality of columns; a top data driver and a bottom data driver; and a plurality of pairs of data lines extending along a vertical direction, each pair of data lines comprising a top data line electrically connected to the top data driver and a bottom data line electrically connected to the bottom data driver, wherein each of the pixels in each column of the pixel matrix is connected to a corresponding pair of data lines. The pixel matrix is divided into a top area, a center area and a bottom area, and for each pair of data lines, the top data line and the bottom data line overlap in the center area. In other words, the center area is an overlapping area. The center area includes a plurality of rows of the pixels. For each column of the pixel matrix, each of the pixels in the center area comprises a top subpixel electrically connected to the top data line of the corresponding pair of data lines and having a first weighting factor, and a bottom subpixel electrically connected to the bottom data line of the corresponding pair of data lines and having a second weighting factor; and from top to bottom of the center area, the first weighting factors of the top subpixels gradually decrease, and the second weighting factors of the bottom subpixels gradually increase. On the other hand, each of the pixels in the top area is only electrically connected to the top data line of the corresponding pair of data lines, and is thus only driven by the corresponding top data driver. Similarly, each of the pixels in the bottom area is only electrically connected to the bottom data line of the corresponding pair of data lines, and is thus only driven by the corresponding bottom data driver.

Figure 2A:
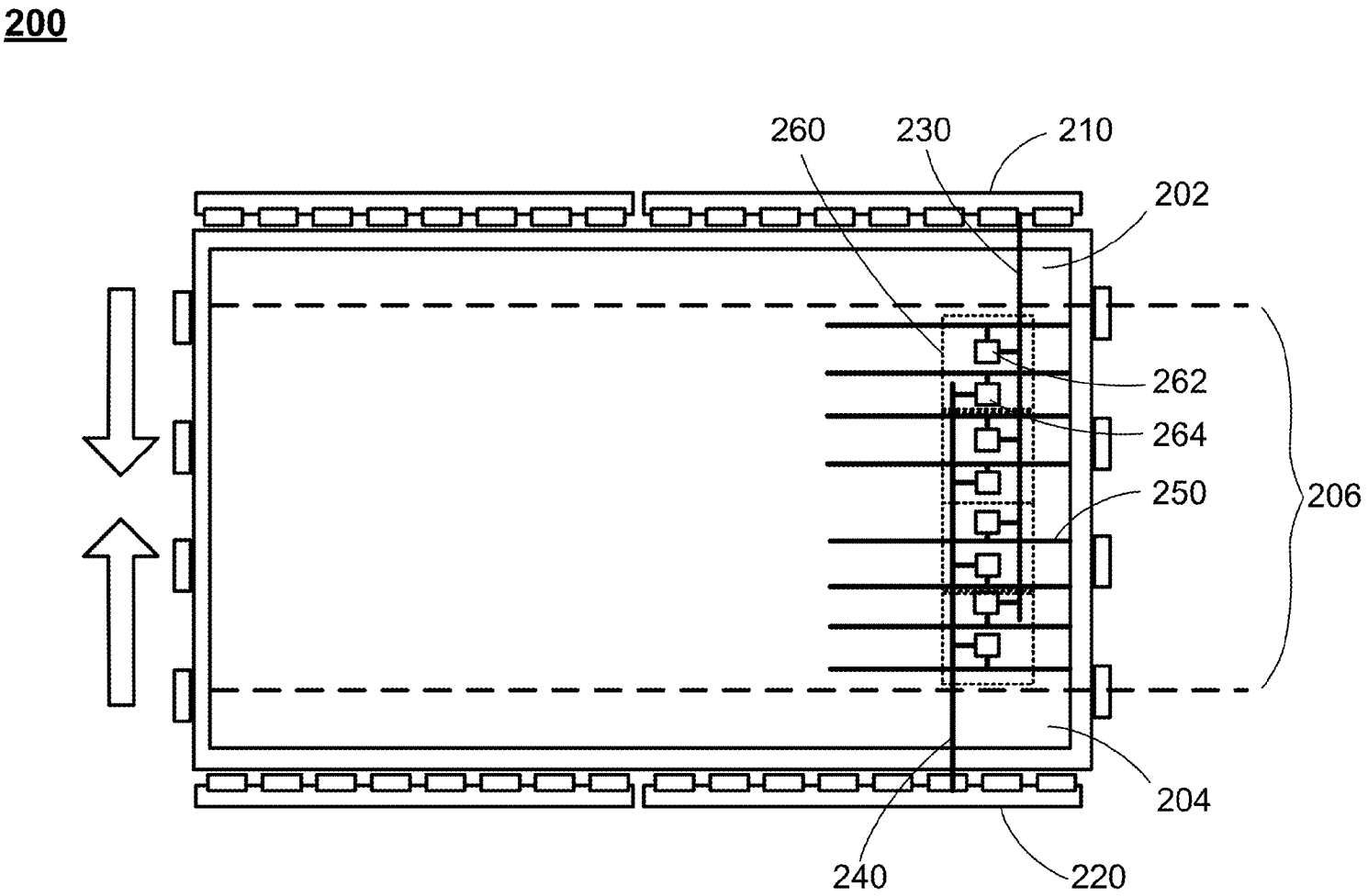
FIG. 2A schematically shows a display device using overlapped data lines according to certain embodiments of the present disclosure.
Figure 2B:
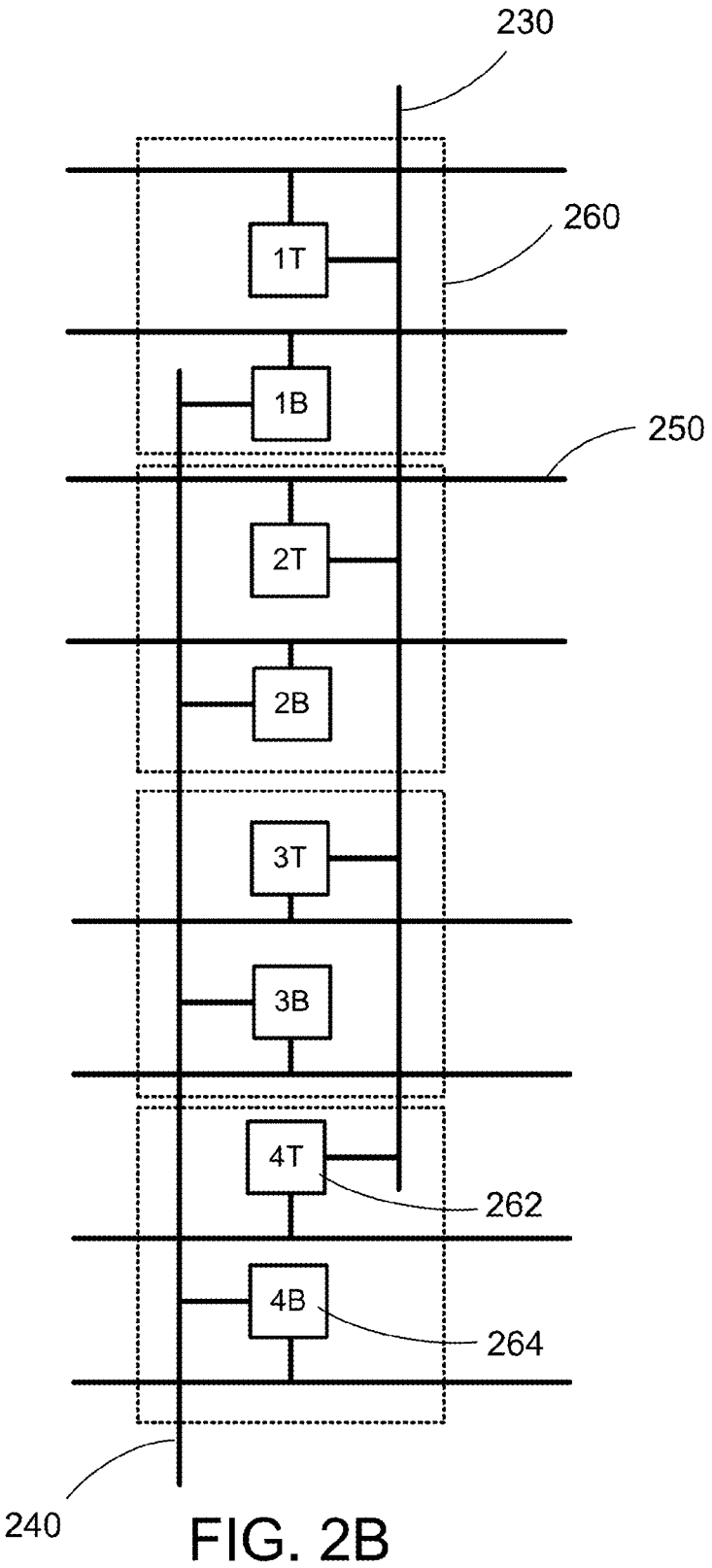
FIG. 2B schematically shows an enlarged view of the pixels in the center area of the display device as shown in FIG. 2A according to certain embodiments of the present disclosure.

FIG. 2A schematically shows a display device using overlapped data lines according to certain embodiments of the present disclosure, and FIG. 2B schematically shows an enlarged view of the pixels in the center area of the display device as shown in FIG. 2A according to certain embodiments of the present disclosure. It should be particularly noted that the components as shown in FIGS. 2A and 2B are provided merely for illustration purposes, and unless explicitly stated in the disclosure, the size, location and connections of the components are not intended to limit the scope of the disclosure.

As shown in FIG. 2A, the display device 200 includes multiple data drivers 210 and 220 at the top and bottom of the display device, a plurality of pairs of data lines 230 and 240 extending along a vertical direction, a plurality of scan lines 250 extending along a horizontal direction that is substantially perpendicular to the data lines, and a plurality of pixels 260 (shown in dotted boxes). Specifically, the pixel matrix is divided into a top area 202, a bottom area 204 and a center area 206 equally dividing the top area 202 and the bottom area 204. The pixels 260 are arranged in a pixel matrix having a plurality of rows and a plurality of columns, and FIG. 2A shows only one column of pixels 260 and one corresponding pair of data lines 230 and 240 in the center area 206, without showing the pixels in the top area 202 and the bottom area 204. The pair of data lines includes a top data line 230 electrically connected to the top data driver 210 and a bottom data line 240 electrically connected to the bottom data driver 220.

As shown in FIGS. 2A and 2B, four rows of pixels 260 in the same column are shown in the center area 206, and each of the pixels 260 is connected to the corresponding pair of data lines 230 and 240. It should be noted that the number of rows of pixels 260 in the center area 206 may vary. For example, the center area 206 may include six rows, eight rows, ten rows or more rows of pixels. In certain embodiments, four rows of pixels in the center area 206 may be sufficient to blur the dividing line that causes the Mura defect.

For each pair of data lines 230 and 240, the top data line 230 and the bottom data line 240 overlap in the center area 206. In other words, the center area 206 is an overlapping area for each pair of data lines 230 and 240. Moreover, each of the four rows of the pixels 260 in the center area 206 includes a top subpixel 262 and a bottom subpixel 264. Each top subpixel 262 is electrically connected to the top data line 230 of the corresponding pair of data lines, and each bottom subpixel 264 is electrically connected to the bottom data line 240 of the corresponding pair of data lines. As shown in FIG. 2B, from top of bottom of the center area 206, the pixel 260 in the first row includes a first top subpixel 262 (labeled as 1T) and a first bottom subpixel 264 (labeled as 1B); the pixel 260 in the second row includes a second top subpixel 262 (labeled as 2T) and a second bottom subpixel 264 (labeled as 2B); the pixel 260 in the third row includes a third top subpixel 262 (labeled as 3T) and a third bottom subpixel 264 (labeled as 3B); and the pixel 260 in the fourth row includes a fourth top subpixel 262 (labeled as 4T) and a fourth bottom subpixel 264 (labeled as 4B). In certain embodiments, assuming the pixel matrix of the display device 200 has 4 rows of pixels in the center area 206, N rows of pixels in the top area 202 and N rows of pixels in the bottom area 204, the pixel matrix has a total of (2*N+4) rows, and each of the top data line 230 and the bottom data line 240 is electrically connected to (N+4) pixels 260.

For the four rows of the pixels 260 in the center area 206, each top subpixel 262 has a corresponding first weighting factor, and each bottom subpixel 264 has a corresponding second weighting factor. The weighting factors of the subpixels 262 and 264 are provided as percentages of the data (or information) being displayed by the subpixels 262 and 264. For each pixel 260, a sum of the first weighting factor of the top subpixel 262 and the second weighting factor of the bottom subpixel 264 is 100%. For example, if the first weighting factor of the top subpixel 262 of a pixel 260 is 75%, the second weighting factor of the bottom subpixel 262 of the same pixel 260 is 25%. In this case, 75% of the data being displayed by the pixel 260 is provided by the top subpixel 262 of the pixel 260, and 25% of the data being displayed by the pixel 260 is provided by the bottom subpixel 264 of the pixel 260. From top to bottom of each row of the center area, the first weighting factors of the top subpixels 262 gradually decrease, and the second weighting factors of the bottom subpixels 264 gradually increase.

Figure 3:
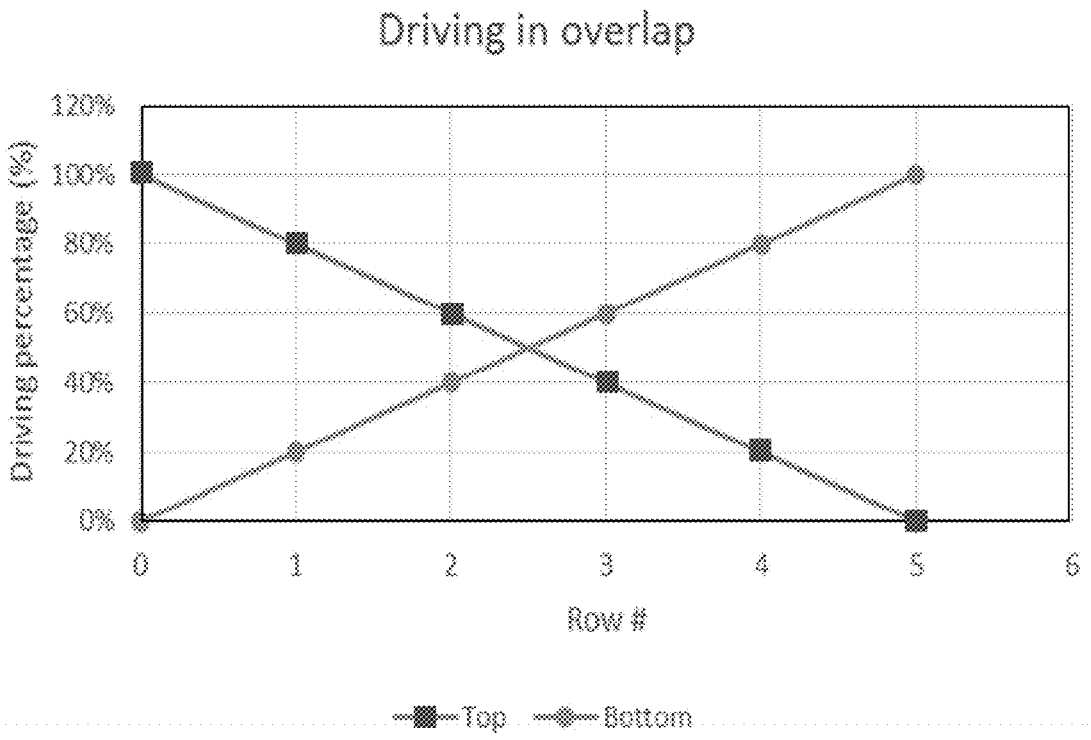
FIG. 3 schematically shows the weighting factors of the subpixels of the pixels in the center area of the display device according to certain embodiments of the present disclosure.

In certain embodiments, the gradual decreasing of the first weighting factors of the top subpixels 262 and the gradual increasing of the second weighting factors of the bottom subpixels 264 from top to bottom may be linear. For example, the first weighting factors of the four top subpixels 262 may be: 80% for the top subpixel 1T, 60% for the top subpixel 2T, 40% for the top subpixel 3T, and 20% for the top subpixel 4T. In other words, the second weighting factors of the four bottom subpixels 264 may be: 20% for the bottom subpixel 1B, 40% for the bottom subpixel 2B, 60% for the bottom subpixel 3B, and 80% for the bottom subpixel 4B. FIG. 3 schematically shows the weighting factors of the subpixels of the pixels in the center area of the display device according to certain embodiments of the present disclosure. As shown in FIG. 3, from top to bottom, the pixel 260 of the first row in the center area 206 may have a 80% top subpixel IT and a 20% bottom subpixel 1B; the pixel 260 of the second row in the center area 206 may have a 60% top subpixel 2T and a 40% bottom subpixel 2B; the pixel 260 of the third row in the center area 206 may have a 40% top subpixel 3T and a 60% bottom subpixel 3B; and the pixel 260 of the fourth row in the center area 206 may have a 20% top subpixel 4T and a 80% bottom subpixel 4B. It should be noted that FIG. 3 shows a row #0 and a row #5. Since the center area 206 includes only four rows of pixels 260, the row #0 refers to a row in the top area 202, where the pixel is only connected to the top data line 230 (i.e., 100% top subpixel and no bottom subpixel), and the row #5 refers to a row in the bottom area 204, where the pixel is only connected to the bottom data line 240 (i.e., 100% bottom subpixel and no top subpixel).

In certain embodiments, for the pixels 260 in each row of the center area 206, the first weighting factors of the top subpixels 262 are identical, and the second weighting factors of the bottom subpixels 264 are identical. For example, from top to bottom, all pixels 260 of the first row in the center area 206 may have a 80% top subpixel IT and a 20% bottom subpixel 1B; all pixels 260 of the second row in the center area 206 may have a 60% top subpixel 2T and a 40% bottom subpixel 2B; all pixels 260 of the third row in the center area 206 may have a 40% top subpixel 3T and a 60% bottom subpixel 3B; and all pixels 260 of the fourth row in the center area 206 may have a 20% top subpixel 4T and a 80% bottom subpixel 4B.

Alternatively, in certain embodiments, the weighting factors of the top and bottom subpixels may exhibit zigzag or random manner In this case, for the pixels 260 in the same row of the center area 206, the first weighting factor of a top subpixel 262 in one column may be different from that of another top subpixel 262 in another column. In other words, at least two of the top subpixels in two different columns have different first weighting factors.

The weighting factors may be implemented in a variety of different methods. In certain embodiments, the weighting factors may be implemented by the proportional sizes of the top and bottom subpixels. In this case, for each of the pixels in the center area, the top subpixel has a first relative size of the pixel proportional to the first weighting factor, and the bottom subpixel has a second relative size of the pixel proportional to the second weighting factor. For example, using the weighting factors of the subpixels as shown in FIG. 3, an example of the relative sizes of the subpixels of the pixels in the center area may be determined, which are listed in the following table.

TABLE 1

Relative sizes of the subpixels of the pixels in the center area

| Row | Relative size of top subpixel | Relative size of bottom subpixel |
|---|---|---|
| 1 | 80% | 20% |
| 2 | 60% | 40% |
| 3 | 40% | 60% |
| 4 | 20% | 80% |

Figure 4A:
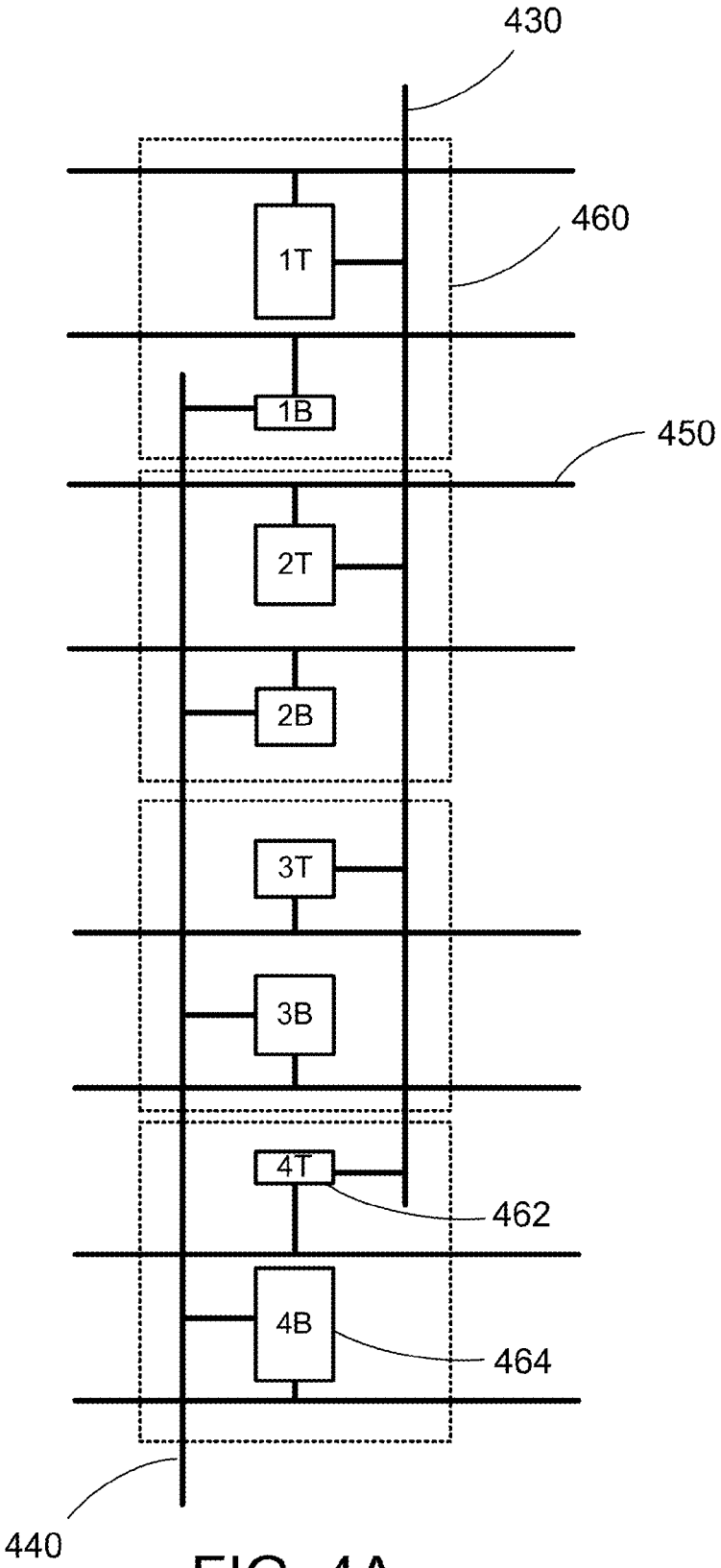
FIG. 4A schematically shows an enlarged view of the pixels in the center area of the display device according to certain embodiments of the present disclosure, where the sizes of the subpixels are proportional to the weighting factors.
Figure 4B:
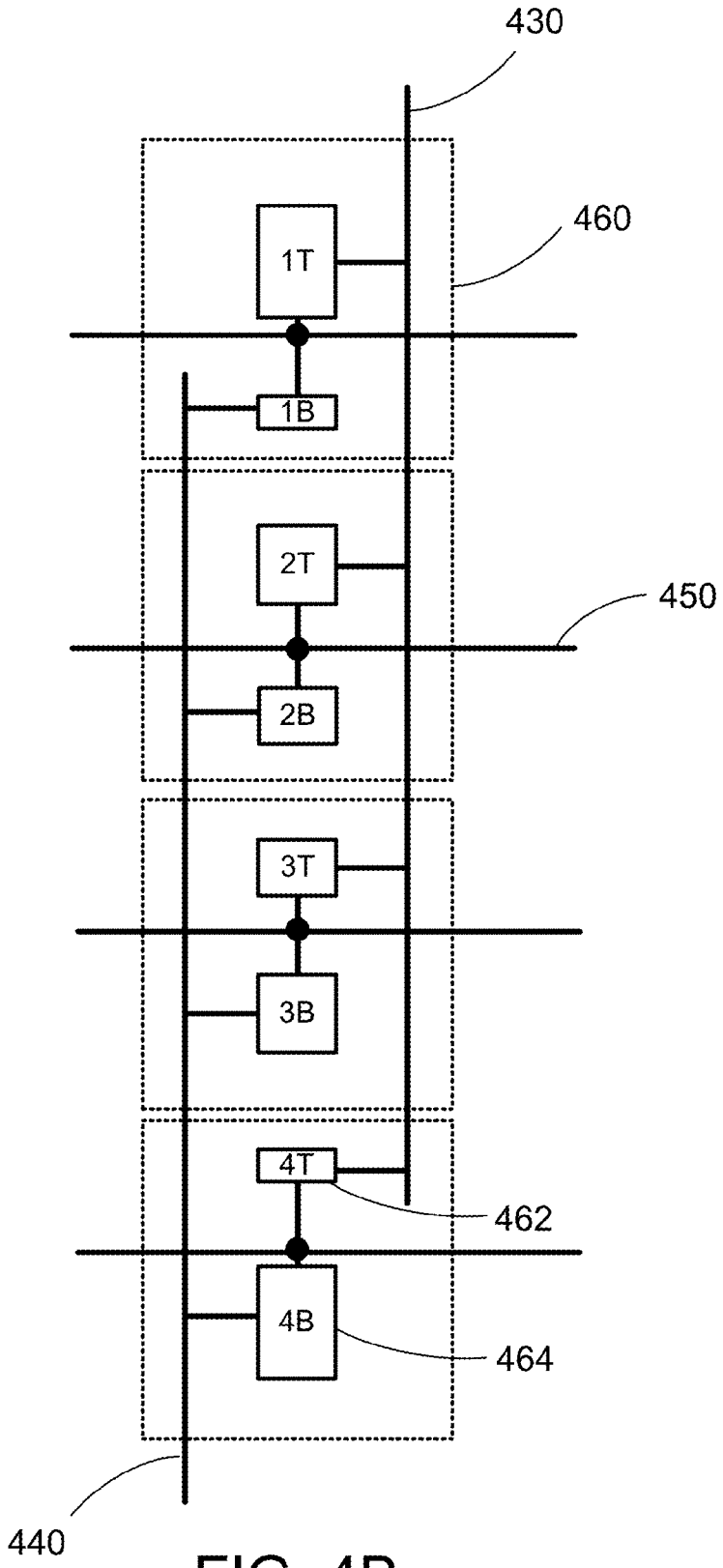
FIG. 4B schematically shows an enlarged view of the pixels in the center area of the display device according to certain embodiments of the present disclosure, where the sizes of the subpixels are proportional to the weighting factors, and the subpixels in each pixel share the same scan line.

FIG. 4A schematically shows an enlarged view of the pixels in the center area of the display device according to certain embodiments of the present disclosure, where the sizes of the subpixels are proportional to the weighting factors. FIG. 4B schematically shows an enlarged view of the pixels in the center area of the display device according to certain embodiments of the present disclosure, where the sizes of the subpixels are proportional to the weighting factors, and the subpixels in each pixel share the same scan line. Specifically, as shown in each of FIGS. 4A and 4B, the sizes of the subpixels 462 and 464 of the pixels are listed in Table 1. From top to bottom, the pixel 460 of the first row in the center area may have a top subpixel 1T having a relative size of 80% of the pixel and a bottom subpixel 1B having a relative size of 20% of the pixel; the pixel 460 of the second row in the center area may have a top subpixel 2T having a relative size of 60% of the pixel and a bottom subpixel 2B having a relative size of 40% of the pixel; the pixel 460 of the third row in the center area may have a top subpixel 3T having a relative size of 40% of the pixel and a bottom subpixel 3B having a relative size of 60% of the pixel; the pixel 460 of the fourth row in the center area may have a top subpixel 4T having a relative size of 20% of the pixel and a bottom subpixel 4B having a relative size of 80% of the pixel. It should be noted that the pixels in the top area and the bottom area may be regular sizes (i.e., 100%). The differences of the pixels as shown in FIGS. 4A and 4B exist in that, as shown in FIG. 4A, except for the sizes of the subpixels 462 and 464, the other structures of the pixels 460 (e.g., the pair of data lines 430 and 440, and the scan lines 450) are similar to the structure of the pixels 260 (e.g., the pair of data lines 230 and 240, and the scan lines 250) as shown in FIG. 2B. In comparison, as shown in FIG. 4B, the two subpixels 462 and 464 of each pixel 460 share the same scan line 450, such that the subpixels may share one transistor (not shown) to open the subpixels 462 and 464. Since the weighting factors are implemented by the sizes of the subpixels 462 and 464, the data voltage signals provided by the data drivers remain the same. In other words, the data voltage signals provided to the subpixels 462 and 464 does not need to be proportional.

In certain embodiments, the weighting factors may be implemented by the proportional data voltage signals provided to the top and bottom subpixels. In this case, for each of the pixels in the center area, a top data voltage received by the top subpixel is proportional to the first weighting factor, and a bottom data voltage received by the bottom subpixel is proportional to the second weighting factor. Different implementations may apply to the display device to provide the proportional data voltage signals. In certain embodiments, software implementation may apply to split the data voltage signals. In certain embodiments, circuitry voltage dividers may be provided to split the data voltage signals.

Figure 5:
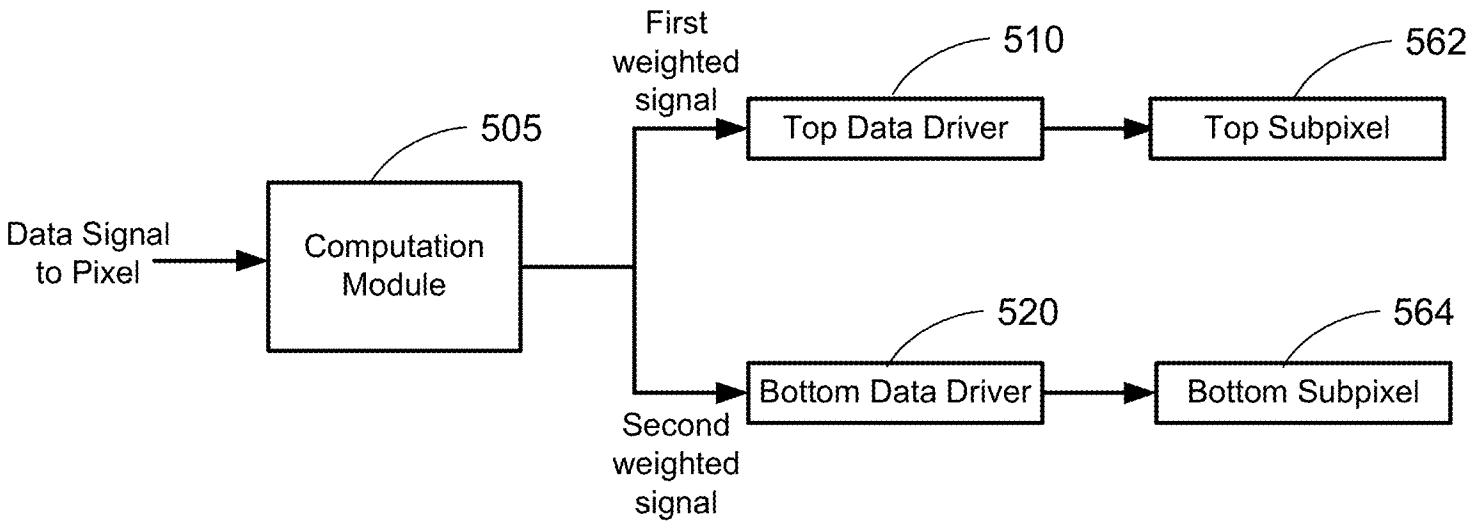
FIG. 5 schematically shows software implementation of proportional data voltage signals for pixels in the center area of the display device according to certain embodiments of the present disclosure.

In certain embodiments, software implementation may apply to split the data voltage signals. FIG. 5 schematically shows software implementation of proportional data voltage signals for pixels in the center area of the display device according to certain embodiments of the present disclosure. As shown in FIG. 5, the display device further includes a computation module 505, which is connected to both the top data driver 510 and the bottom data driver 520. In certain embodiments, the computation module 505 may be configured to calculate the top data voltage and the bottom data voltage signals for each of the pixels in the center area using the weighting factors of the subpixels 562 and 564. For example, the computation module 505 may receive a target gray level value for a specific pixel. In response, the computation module 505 multiplies the target gray level value for the pixel with the corresponding weighting factors of the top and bottom subpixels 562 and 564 to obtain weighted values for the top and bottom subpixels 562 and 564, and then calculate the data voltage signals for the top and bottom data drivers 510 and 520 using the weighted values. Once the data voltage signals are obtained, the computation module 505 may control the top data driver 510 to provide the first data voltage signal to the top subpixel 562, and control the bottom data driver 520 to provide the second data voltage signal to the bottom subpixel 564. In this case, the size of each of the top and bottom subpixels 562 and 564 may remain the constant regular size (i.e., 100%).

Figure 6:
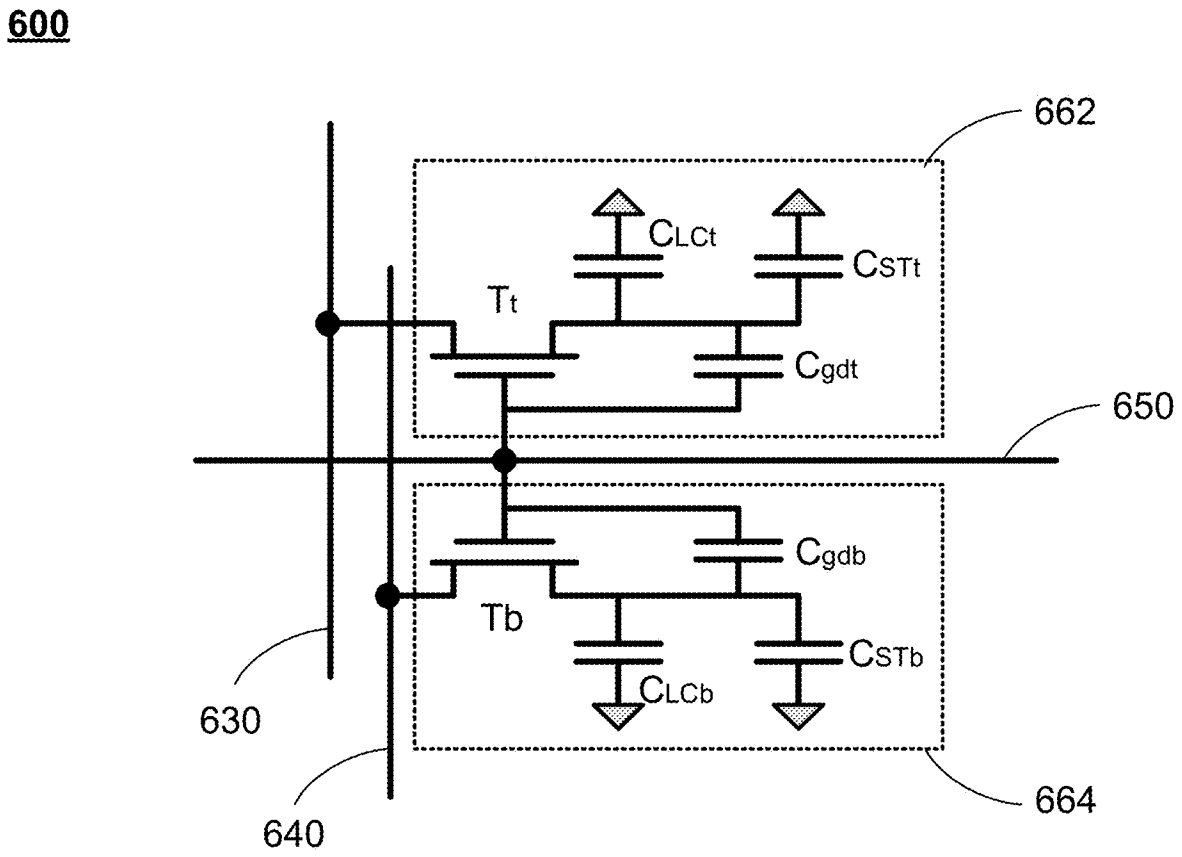
FIG. 6 schematically shows a pixel structure of a pixel in the center area of the display device according to certain embodiments of the present disclosure.

In certain embodiments, circuitry voltage dividers may be provided to split the data voltage signals. In certain embodiments, the voltage dividers used to split the data voltage signals may be implemented by variable capacitors. FIG. 6 schematically shows a pixel structure of a pixel in the center area of the display device according to certain embodiments of the present disclosure. As shown in FIG. 6, the pixel 600 includes a top subpixel 662 and a bottom subpixel 664. Each of the top subpixel 662 and the bottom subpixel 664 includes a thin-film transistor (TFT) T, a liquid crystal capacitor $C_{LC}$, a storage capacitor $C_{ST}$, and a parasitic capacitor $C_{gd}$. Each of the TFTs Tt and Tb has a gate, a source and a drain. The gate of the TFTs Tt and Tb are respectively connected to the scan line 650. The source of the TFT Tt of the top subpixel 662 is connected to the top data line 630, and the source of the TFT Tb of the bottom subpixel 664 is connected to the bottom data line 640. For each of the top subpixel 662 and the bottom subpixel 664, the liquid crystal capacitor $C_{LC}$ provides a capacitance of the liquid crystal, the storage capacitor $C_{ST}$ provides a storage capacitance of the subpixel, and the parasitic capacitor $C_{gd}$ is connected between the gate and the drain of the TFT.

Figure 7:
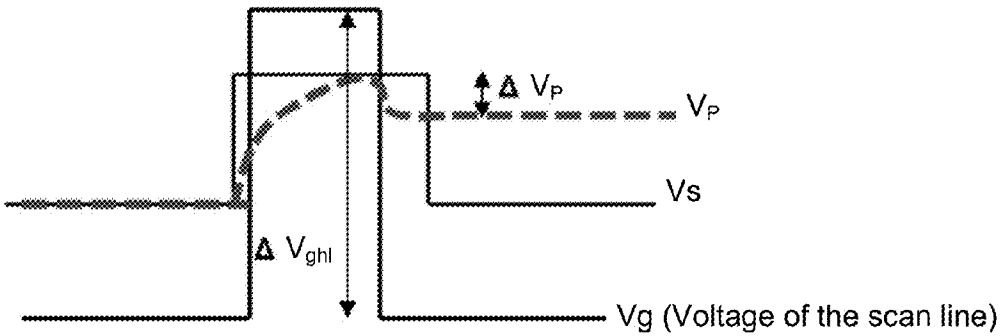
FIG. 7 schematically shows the waveform of a refreshing pixel according to certain embodiments of the present disclosure.

FIG. 7 schematically shows the waveform of a refreshing pixel according to certain embodiments of the present disclosure. For a refreshing pixel (i.e, each of the top subpixel 662 and the bottom subpixel 664), the voltage Vp of the pixel after refreshing is:

$$Vp=Vs-\Delta Vp \tag{1}$$

where Vs is the voltage provided by the corresponding data driver (i.e., the source driver) and ΔVp is a feed through voltage. Further, the feed through voltage ΔVp is dependent on the storage capacitance of the storage capacitor $C_{ST}$ of the pixel, as shown in the following formula:

$$\Delta Vp=[(C_{LC}+C_{ST}+C_{gd})/C_{ST}]*\Delta Vghl \tag{2}$$

where ΔVghl is the voltage amplitude of the gate driving signal.

Thus, the capacitance of the storage capacitor $C_{ST}$ is a factor of the final voltage written into the pixel electrode of a pixel. Accordingly, the capacitance of the storage capacitor $C_{ST}$ may be adjusted in order to control the final voltage written into the pixel electrode of the pixel. Moreover, the loading capacitance ($C_{LC}$+$C_{ST}$) can also influence the charging rate of the pixels and thus influence the final voltages of the pixels. Therefore, the storage capacitance of the pixels may be respectively arranged to control the weighting factor ratio of the data in each pixel. In other words, the percentage (i.e., the weighting factors) of the data voltage signal to the subpixels 662 and 664 may be controlled by adjusting the capacitance of each of the storage capacitor $C_{STt}$ of the top subpixel 662 and the storage capacitor $C_{STb}$ of the bottom subpixel 664.

Figure 8:
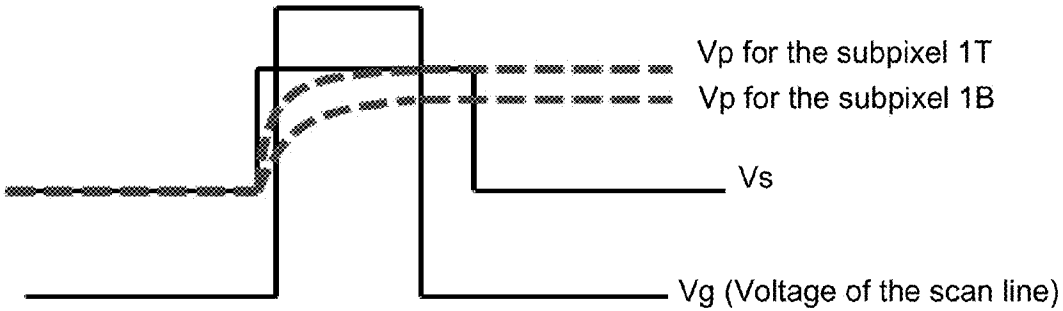
FIG. 8 schematically shows the waveform of the subpixels of a pixel in the center area of the display device according to certain embodiments of the present disclosure.

FIG. 8 schematically shows the waveform of the subpixels of a pixel in the center area of the display device according to certain embodiments of the present disclosure. As shown in FIG. 8, for the subpixels IT and 1B of the pixel, the storage capacitor $C_{STt}$ of the top subpixel 1T has a greater capacitance than that of the storage capacitors $C_{STb}$ of the bottom subpixel 1B. In this case, the data for the subpixel IT may occupy greater percentage (i.e., weighting factor) than the data for the subpixel 1B.

Figure 9:
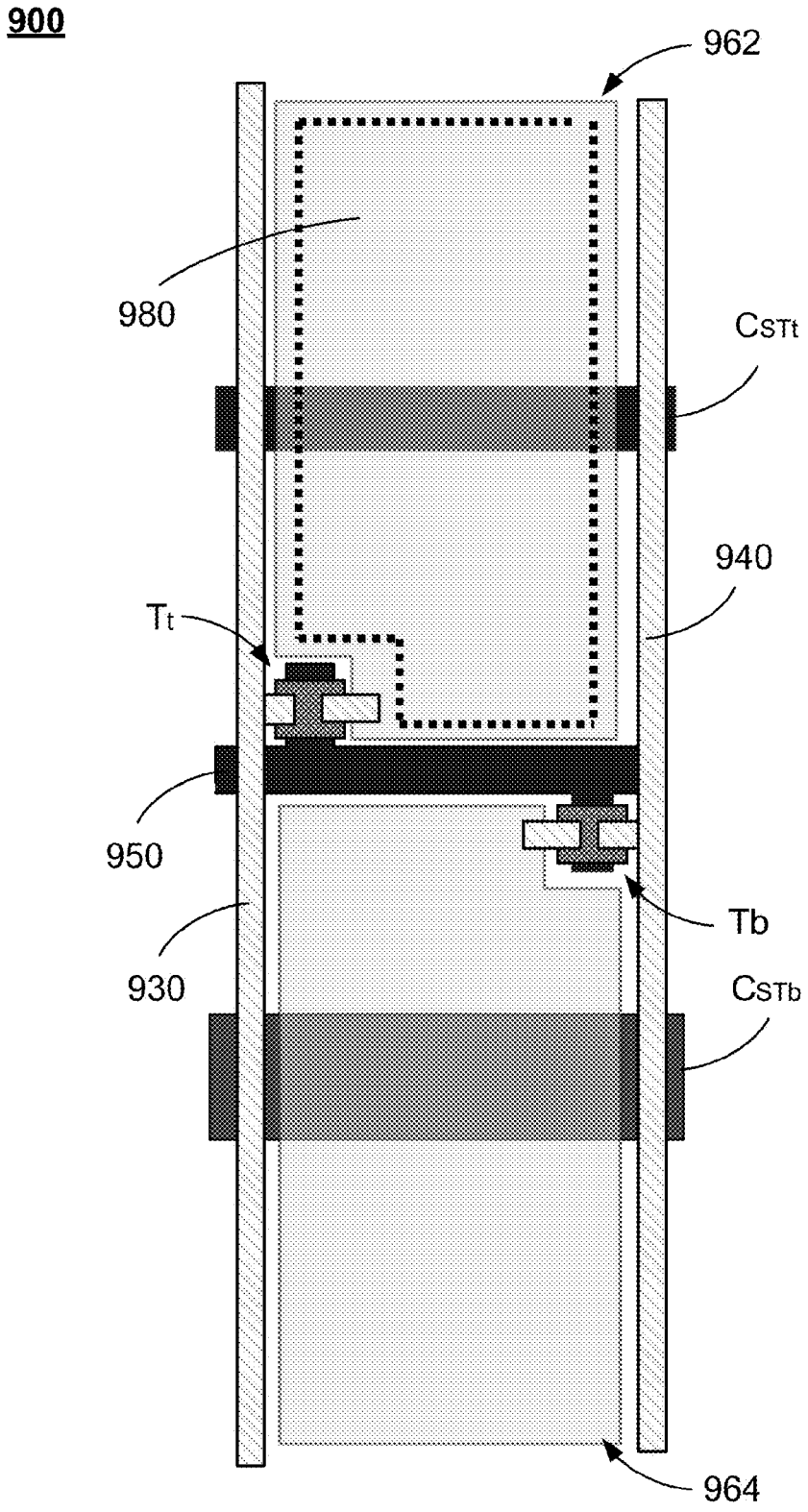
FIG. 9 schematically shows a pixel structure of a pixel in the center area of the display device as shown in FIG. 6 according to certain embodiments of the present disclosure.

FIG. 9 schematically shows a pixel structure of a pixel in the center area of the display device as shown in FIG. 6 according to certain embodiments of the present disclosure. Specifically, the pixel 900 as shown in FIG. 9 is identical to the pixel as shown in FIG. 6, which includes a top subpixel 962 and a bottom subpixel 964. Each of the top subpixel 962 and the bottom subpixel 964 respectively includes a pixel electrode 6980. The top subpixel 962 and the bottom subpixel 964 respectively include the TFTs Tt and Tb and the storage capacitors $C_{STt}$ and $C_{STb}$. Each of the TFTs Tt and Tb has a gate, a source and a drain. The gate of the TFTs Tt and Tb are respectively connected to the scan line 950. The source of the TFT Tt of the top subpixel 962 is connected to the top data line 930, and the source of the TFT Tb of the bottom subpixel 964 is connected to the bottom data line 940. As shown in FIG. 9, the storage capacitor $C_{STb}$ of the bottom subpixel 664 has a greater capacitance than that of the storage capacitor $C_{STt}$ of the top subpixel 962. In this case, the data for the subpixel 964 may occupy greater percentage (i.e., weighting factor) than the data for the subpixel 962.

There are other implementations for the voltage dividers used to split the data voltage signals. In certain embodiments, the W/L ratio of the TFTs for the different pixels may be adjusted to control the amount of charging that is done per subpixel. In certain embodiments, temporal dithering may be used, such that in one frame the overlap pixels may be driven from the top, with the weighting factors, and in the second frame the overlap pixels may be driven from the bottom, again with the proper weighting factors.

In certain embodiments, the voltage dividers used to split the data voltage signals may be implemented by resistors that are patterned in the active plates. Specifically, for each of the top and bottom subpixels of the pixel in the center area, a plurality of resistors may be provided to split the voltage provided to the source of the top and bottom subpixels. In certain embodiments, each pixel in the center area may include: at least one top resistor connected to the top subpixel, configured to split a voltage provided by the top data driver to the source of the top transistor, such that the top data voltage received by the top subpixel is the voltage provided by the top data driver multiplying the first weighting factor; and at least one bottom resistor connected to the bottom subpixel, configured to split a voltage provided by the bottom data driver to the source of the bottom transistor, such that the bottom data voltage received by the bottom subpixel is the voltage provided by the bottom data driver multiplying the second weighting factor. In this case, the data voltage signals received by the top and the bottom subpixels may be voltages multiplying the corresponding weighting factors.

In a further aspect of the disclosure, a pixel driving method may be applied to the display device as described above, by providing the corresponding data voltage signals to the corresponding subpixels of the pixels in the center area of the display device.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A display device, comprising:

a plurality of pixels arranged in a pixel matrix having a plurality of rows and a plurality of columns;

a top data driver and a bottom data driver respectively disposed at opposite two sides of the display device; and a plurality of pairs of data lines extending along a vertical direction, each pair of data lines comprising a top data line electrically connected to the top data driver and a bottom data line electrically connected to the bottom data driver, wherein each of the plurality of pixels in each column of the pixel matrix is connected to a corresponding pair of data lines;

wherein the pixel matrix is divided into a top area, a center area and a bottom area, and for each pair of data lines, the top data line and the bottom data line overlap in the center area and do not overlap in the top area and the bottom area;

wherein for each column of the pixel matrix, each of the plurality of pixels in the top area is electrically connected to the top data line of the corresponding pair of data lines;

each of the plurality of pixels in the bottom area is electrically connected to the bottom data line of the corresponding pair of data lines;

each of the plurality of pixels in the center area comprises a top subpixel electrically connected to the top data line of the corresponding pair of data lines and having a first weighting factor, and a bottom subpixel electrically connected to the bottom data line of the corresponding pair of data lines and having a second weighting factor, wherein a sum of the first weighting factor of the top subpixel and the second weighting factor of the bottom subpixel is 100%; and from top to bottom of the center area, the first weighting factors of the top subpixels gradually decrease, and the second weighting factors of the bottom subpixels gradually increase;

wherein the center area comprises, from top to bottom of the center area:

a first row of pixels, each having a first top subpixel and a first bottom subpixel;

a second row of pixels, each having a second top subpixel and a second bottom subpixel;

a third row of pixels, each having a third top subpixel and a third bottom subpixel; and a fourth row of pixels, each having a fourth top subpixel and a fourth bottom subpixel.

2. The display device of claim 1, wherein:

for each of the pixels in the first row, the first weighting factor of the first top subpixel is 80%, and the second weighting factor of the first bottom subpixel is 20%;

for each of the pixels in the second row, the first weighting factor of the second top subpixel is 60%, and the second weighting factor of the second bottom subpixel is 40%;

for each of the pixels in the third row, the first weighting factor of the third top subpixel is 40%, and the second weighting factor of the third bottom subpixel is 60%; and for each of the pixels in the fourth row, the first weighting factor of the fourth top subpixel is 20%, and the second weighting factor of the fourth bottom subpixel is 80%.

3. A display device, comprising:

a plurality of pixels arranged in a pixel matrix having a plurality of rows and a plurality of columns;

a top data driver and a bottom data driver respectively disposed at opposite two sides of the display device; and a plurality of pairs of data lines extending along a vertical direction, each pair of data lines comprising a top data line electrically connected to the top data driver and a bottom data line electrically connected to the bottom data driver, wherein each of the plurality of pixels in each of the plurality of columns of the pixel matrix is connected to a corresponding pair of data lines;

wherein the pixel matrix is divided into a top area, a center area and a bottom area, and for each pair of data lines, the top data line and the bottom data line overlap in the center area;

wherein the center area comprises a plurality of rows of the pixels;

wherein for each column of the pixel matrix, each of the plurality of pixels in the center area comprises a top subpixel electrically connected to the top data line of the corresponding pair of data lines and having a first weighting factor, and a bottom subpixel electrically connected to the bottom data line of the corresponding pair of data lines and having a second weighting factor; and from top to bottom of each row of the center area, the first weighting factors of the top subpixels gradually decrease, and the second weighting factors of the bottom subpixels gradually increase; and wherein for each of the pixels in the center area, a top data voltage received by the top subpixel is proportional to the first weighting factor, and a bottom data voltage received by the bottom subpixel is proportional to the second weighting factor.

4. The display device of claim 3, wherein for each column of the pixel matrix, each of the pixels in the top area is electrically connected to the top data line of the corresponding pair of data lines; and each of the pixels in the bottom area is electrically connected to the bottom data line of the corresponding pair of data lines.

5. The display device of claim 3, wherein for each of the pixels in the center area, a sum of the first weighting factor of the top subpixel and the second weighting factor of the bottom subpixel is 100%.

6. The display device of claim 3, wherein the gradual decreasing of the first weighting factors of the top subpixels and the gradual increasing of the second weighting factors of the bottom subpixels from top to bottom are linear.

7. The display device of claim 3, wherein for the pixels in each row of the center area, the first weighting factors of the top subpixels are identical, and the second weighting factors of the bottom subpixels are identical.

8. The display device of claim 3, wherein for the pixels in each row of the center area, at least two of the top subpixels have different first weighting factors.

9. The display device of claim 3, wherein the center area comprises, from top to bottom of the center area:

a first row of pixels, each having a first top subpixel and a first bottom subpixel;

a second row of pixels, each having a second top subpixel and a second bottom subpixel;

a third row of pixels, each having a third top subpixel and a third bottom subpixel; and a fourth row of pixels, each having a fourth top subpixel and a fourth bottom subpixel, wherein:

for each of the pixels in the first row, the first weighting factor of the first top subpixel is 80%, and the second weighting factor of the first bottom subpixel is 20%;

for each of the pixels in the second row, the first weighting factor of the second top subpixel is 60%, and the second weighting factor of the second bottom subpixel is 40%;

for each of the pixels in the third row, the first weighting factor of the third top subpixel is 40%, and the second weighting factor of the third bottom subpixel is 60%; and for each of the pixels in the fourth row, the first weighting factor of the fourth top subpixel is 20%, and the second weighting factor of the fourth bottom subpixel is 80%.

10. The display device of claim 3, wherein for each of the pixels in the center area, the top subpixel has a relative size of the pixel proportional to the first weighting factor, and the bottom subpixel has a relative size of the pixel proportional to the second weighting factor.

11. The display device of claim 3, further comprising:

a computation module configured to, for each of the pixels in the center area:

calculate the top data voltage and the bottom data voltage according to the first and second weighting factors;

control the top data driver to provide the top data voltage to the top subpixel; and control the bottom data driver to provide the bottom data voltage to the bottom subpixel.

12. The display device of claim 3, further comprising:

a plurality of scan lines extending along a direction perpendicular to the pairs of data lines, each of the scan lines corresponding to one of the rows of pixels;

wherein for each of the pixels in the center area, the top subpixel comprises a top transistor having a gate, a source and a drain, and the bottom subpixel comprises a bottom transistor having a gate, a source and a drain, wherein the source of the top transistor is electrically connected to the top data line of the corresponding pair of data lines, the source of the bottom transistor is electrically connected to the bottom data line of the corresponding pair of data lines, and the gate of the top transistor and the gate of the bottom transistor are respectively electrically connected to the corresponding scan line.

13. The display device of claim 12, wherein each of the plurality of pixels in the center area further comprises:

at least one top resistor connected to the top subpixel, configured to split a voltage provided by the top data driver to the source of the top transistor, such that the top data voltage received by the top subpixel is the voltage provided by the top data driver multiplying the first weighting factor; and at least one bottom resistor connected to the bottom subpixel, configured to split a voltage provided by the bottom data driver to the source of the bottom transistor, such that the bottom data voltage received by the bottom subpixel is the voltage provided by the bottom data driver multiplying the second weighting factor.

14. The display device of claim 12, wherein each of the plurality of pixels in the center area further comprises:

a plurality of top capacitors electrically connected to the drain of the top transistor, comprising a top storage capacitor $C_{STt}$; and a plurality of bottom capacitors electrically connected to the drain of the bottom transistor, comprising a bottom storage capacitor $C_{STb}$;

wherein capacitances of the top storage capacitor $C_{STt}$ and the bottom storage capacitor $C_{STb}$ are respectively configured such that the top data voltage received by the top subpixel is proportional to the first weighting factor, and the bottom data voltage received by the bottom subpixel is proportional to the second weighting factor.

15. A display device, comprising:

a plurality of pixels arranged in a pixel matrix having a plurality of rows and a plurality of columns;

a top data driver and a bottom data driver respectively disposed at opposite two sides of the display device; and a plurality of pairs of data lines extending along a vertical direction, each pair of data lines comprising a top data line electrically connected to the top data driver and a bottom data line electrically connected to the bottom data driver, wherein each of the plurality of pixels in each of the plurality of columns of the pixel matrix is electrically connected to a corresponding pair of data lines;

wherein the pixel matrix is divided into a top area, a center area and a bottom area, and for each pair of data lines, the top data line and the bottom data line overlap in the center area and do not overlap in the top area and the bottom area;

wherein the center area comprises a plurality of rows of the pixels; and wherein for each column of the pixel matrix, each of the plurality of pixels in the center area comprises a top subpixel electrically connected to the top data line of the corresponding pair of data lines and having a first relative size of the pixel, and a bottom subpixel electrically connected to the bottom data line of the corresponding pair of data lines and having a second relative size of the pixel; and from top to bottom of each row of the center area, the first relative sizes of the pixel gradually decrease, and the second relative size of the pixel gradually increase.

16. The display device of claim 15, wherein the decreasing manner of the first relative sizes of the pixels among the plurality of columns is in a random or zigzag manner.

17. The display device of claim 15, wherein:

for each column of the pixel matrix, each of the top subpixel has a first weighting factor, and each of the bottom subpixel has a second weighting factor; and from top to bottom of each row of the center area, the first weighting factors of the top subpixels gradually decrease, and the second weighting factors of the bottom subpixels gradually increase.

18. The display device of claim 17, wherein for each of the top subpixel, the first relative size of the pixel is proportional to the first weighting factor, and for each of the bottom subpixel, the second relative size of the pixel is proportional to the second weighting factor.

19. The display device of claim 1, wherein for each of the pixels in the center area, a top data voltage received by the top subpixel is proportional to the first weighting factor, and a bottom data voltage received by the bottom subpixel is proportional to the second weighting factor.

20. The display device of claim 17, wherein for each of the pixels in the center area, a top data voltage received by the top subpixel is proportional to the first weighting factor, and a bottom data voltage received by the bottom subpixel is proportional to the second weighting factor.

* * * * *